US007063523B2

(12) United States Patent
Skinner

(10) Patent No.: US 7,063,523 B2
(45) Date of Patent: Jun. 20, 2006

(54) COMPRESSOR DISCHARGE ASSEMBLY

(75) Inventor: Robin G Skinner, Tecumseh, MI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 10/657,582

(22) Filed: Sep. 8, 2003

(65) Prior Publication Data

US 2004/0057858 A1 Mar. 25, 2004

Related U.S. Application Data

(60) Provisional application No. 60/412,871, filed on Sep. 23, 2002.

(51) Int. Cl.
*F01C 1/02* (2006.01)
*F04C 18/00* (2006.01)

(52) U.S. Cl. ..... 418/55.6; 418/1; 418/55.1; 418/96; 184/6.17

(58) Field of Classification Search ..... 418/55.1, 418/55.2, 55.6, 270, 63, 1, 96; 184/6.17
See application file for complete search history.

(56) References Cited

U.S. PATENT DOCUMENTS

| | | | | |
|---|---|---|---|---|
| 2,661,172 | A | | 12/1953 | Needham |
| 3,039,725 | A | | 6/1962 | Kerley, Jr. |
| RE25,569 | E | | 5/1964 | Coron et al. |
| 3,145,960 | A | | 8/1964 | Langdon |
| 3,749,340 | A | | 7/1973 | Williams et al. |
| 3,785,167 | A | | 1/1974 | Sahs |
| 4,089,613 | A | | 5/1978 | Babbitt, Jr. |
| 4,244,680 | A | | 1/1981 | Ishizuka et al. |
| 4,389,171 | A | | 6/1983 | Eber et al. |
| 4,416,594 | A | * | 11/1983 | Ichikawa ..... 417/360 |
| 4,497,615 | A | | 2/1985 | Griffith |
| 4,518,276 | A | | 5/1985 | Mitchell et al. |
| 4,552,518 | A | | 11/1985 | Utter |
| 4,557,677 | A | | 12/1985 | Hasegawa |
| 4,685,188 | A | | 8/1987 | Goy |
| 4,767,293 | A | | 8/1988 | Caillat et al. |

(Continued)

FOREIGN PATENT DOCUMENTS

FR 2 755 477 A1 11/1997

(Continued)

OTHER PUBLICATIONS

U.S. Appl. No. 10/657,311 entitled Compressor Assembly Having Crankcase, filed Sep. 8, 2003.

(Continued)

*Primary Examiner*—Theresa Trieu
(74) *Attorney, Agent, or Firm*—Baker & Daniels

(57) ABSTRACT

A compressor assembly having a housing in which a compressor mechanism and discharge chamber are located. A first port communicates compressed gas and oil from the compressor mechanism to the discharge chamber. A one-way valve allows the compressed gas and oil to enter the discharge chamber through the first port. A second port in the discharge chamber defines an outlet in the housing through which compressed gas and oil are discharged from the compressor assembly. The second port is disposed vertically below the first port in the lower half of the discharge chamber to thereby limit the quantity of oil which may collect in the discharge chamber. The second port may be defined by a discharge tube which passes through the housing at a flat portion of the housing which thereby facilitates the welding of the tube to the housing.

16 Claims, 5 Drawing Sheets

U.S. PATENT DOCUMENTS 4,792,288 A 12/1988 Gromoll et al.
4,818,198 A 4/1989 Tamura et al.
4,877,382 A 10/1989 Caillat et al.
4,992,033 A 2/1991 Caillat et al.
5,012,896 A 5/1991 Da Costa
5,055,010 A 10/1991 Logan
5,062,779 A 11/1991 Da Costa
5,110,268 A 5/1992 Sakurai et al.
5,114,322 A 5/1992 Caillat et al.
5,137,437 A 8/1992 Machida et al.
5,176,506 A 1/1993 Siebel
5,211,031 A 5/1993 Murayama et al.
RE34,297 E 6/1993 Elson
5,219,281 A 6/1993 Caillat et al.
5,222,885 A * 6/1993 Cooksey ..... 418/96
5,224,845 A 7/1993 Mangyo et al.
5,240,391 A 8/1993 Ramshankar et al.
5,247,738 A 9/1993 Yoshii
5,312,234 A 5/1994 Yoshii
5,345,785 A 9/1994 Sekigami et al.
5,345,970 A 9/1994 Leyderman et al.
5,346,375 A 9/1994 Akiyama et al.
5,348,455 A * 9/1994 Herrick et al. ..... 418/63
5,370,156 A 12/1994 Peracchio et al.
5,391,066 A 2/1995 Sawai et al.
5,427,511 A 6/1995 Caillat et al.
5,474,433 A 12/1995 Chang et al.
5,487,648 A 1/1996 Alfano et al.
5,522,715 A 6/1996 Watanabe et al.
5,531,577 A 7/1996 Hayase et al.
5,533,875 A 7/1996 Crum et al.
5,579,651 A 12/1996 Sugiyama et al.
5,580,233 A 12/1996 Wakana et al.
5,597,293 A 1/1997 Bushnell et al.
5,597,296 A 1/1997 Akazawa et al.
5,634,781 A 6/1997 Yoshida et al.
5,645,408 A 7/1997 Fujio et al.
5,660,539 A 8/1997 Matsunaga et al.
5,683,237 A 11/1997 Hagiwara et al.
5,695,326 A 12/1997 Oka et al.
5,716,202 A 2/1998 Koyama et al.
5,720,601 A 2/1998 Tark et al.
5,745,992 A 5/1998 Caillat et al.
5,752,688 A 5/1998 Campbell et al.
5,769,126 A 6/1998 Cho
5,772,411 A 6/1998 Crum et al.
5,772,416 A 6/1998 Caillat et al.
5,775,894 A 7/1998 Kosco, Jr.
5,810,572 A 9/1998 Yamamoto et al.
5,829,959 A 11/1998 Tsubono et al.
5,863,190 A 1/1999 Yamamoto et al.
5,913,892 A 6/1999 Kwon
5,931,649 A 8/1999 Caillat et al.
5,931,650 A 8/1999 Yasu et al.
5,947,709 A 9/1999 Koyama et al.
5,964,581 A 10/1999 Iizuka et al.
6,000,917 A 12/1999 Smerud et al.
6,011,336 A 1/2000 Mathis et al.
6,027,321 A 2/2000 Shim et al.
6,039,551 A 3/2000 Takeuchi et al.
6,050,794 A 4/2000 Noboru et al.
6,056,523 A 5/2000 Won et al.
6,106,254 A 8/2000 Hirooka et al.
6,132,191 A 10/2000 Hugenroth et al.
6,139,291 A 10/2000 Perevozchikov
6,156,106 A 12/2000 Kamata
6,162,035 A 12/2000 Hayano et al.
6,167,719 B1 1/2001 Yakumaru et al.
6,171,076 B1 1/2001 Gannaway
6,179,589 B1 1/2001 Bass et al.
6,186,753 B1 2/2001 Hugenroth et al.
6,224,356 B1 5/2001 Dewar et al.
6,227,830 B1 5/2001 Fields et al.
6,247,910 B1 6/2001 Yokoyama
6,261,073 B1 7/2001 Kumazawa
6,264,446 B1 7/2001 Rajendran et al.
6,280,154 B1 8/2001 Clendenin et al.
6,299,423 B1 10/2001 Perevozchikov
6,305,912 B1 10/2001 Svendsen et al.
6,402,485 B1 6/2002 Hong et al.
2001/0006603 A1 7/2001 Hong et al.
2001/0055536 A1 12/2001 Bernardi et al.

FOREIGN PATENT DOCUMENTS

JP 61087994 5/1986
JP 402061382 A 3/1990
JP 05288171 A * 11/1993
JP 407259764 A 10/1995
JP 10148191 A 6/1998
JP 02001020881 A 1/2001
JP 2001271752 A * 10/2001
JP 2001304145 A * 10/2001
JP 2002021729 A * 1/2002
JP 2002098056 A 4/2002

OTHER PUBLICATIONS

U.S. Appl. No. 10/657,637 entitled Compressor Having Discharge Valve, filed Sep. 8, 2003.
U.S. Appl. No. 10/657,653 entitled Compressor Having Bearing Support, filed Sep. 8, 2003.
U.S. Appl. No. 10/657,382 entitled Compressor Mounting Bracket and Method of Making, filed Sep. 8, 2003.
U.S. Appl. No. 10/657,309 entitled Compressor Having Alignment Bushings and Assembly Method, filed Sep. 8, 2003.
U.S. Appl. No. 10/657,310 entitled Compressor Having Counterweight Shield, filed Sep. 8, 2003.
U.S. Appl. No. 10/657,652 entitled Compressor Assembly Having Baffle, filed Sep. 8, 2003.

* cited by examiner

COMPRESSOR DISCHARGE ASSEMBLY

CROSS REFERENCE TO RELATED APPLICATIONS

This application claims priority under 35 U.S.C. 119(e) of U.S. provisional patent application Ser. No. 60/412,871 filed on Sep. 23, 2002 entitled COMPRESSOR DISCHARGE ASSEMBLY the disclosure of which is hereby incorporated by reference.

BACKGROUND OF THE INVENTION

1. Field of the Invention

The present invention relates to compressors and, more particularly, the discharge chamber of a scroll compressor.

2. Description of the Related Art

Conventional scroll compressors having a hermetically sealed housing in which the scrolls and a motor are housed. Lubricating oil is also present within the housing and oftentimes collects in the lower portion of the housing which thereby acts as an oil sump. The movement of the lubricating oil within the compressor during operation of the compressor, however, can lead to lubricating oil collecting in locations where it is undesirable for such lubricating oil to collect.

A scroll compressor which provides for the improved control and regulation of lubricating oil within the housing is desirable.

SUMMARY OF THE INVENTION

The present invention provides a scroll compressor having a discharge chamber with a discharge outlet which is positioned to prevent the excess accumulation of lubricating oil within the discharge chamber.

The invention comprises, in one form thereof, a compressor assembly for compressing a gas and lubricated with an oil which includes a housing, a discharge chamber defined within the housing and a compressor mechanism disposed within the housing. The compressor mechanism defines a working space in which gas is compressed and has a first port in communication with the discharge chamber whereby compressed gas and oil are communicated from the working space to the discharge chamber. A second port is located in the discharge chamber and defines an outlet in the housing through which compressed gas and oil are discharged from the compressor assembly. The second port is disposed vertically below the first port in a lower half of the discharge chamber whereby oil collected within the discharge chamber is dischargable with the compressed gas through the second port and wherein substantially all fluids entering the discharge chamber enter through the first port and substantially all fluids exiting the discharge chamber exit through the second port.

The compressor assembly may also include a valve sealingly engageable with the first port wherein the valve allows fluids to enter the discharge chamber from the working space and inhibits passage of fluids from the discharge chamber to the working space. The compressor assembly also includes a discharge tube wherein the discharge tube has an inlet positioned in the discharge chamber which defines the second port. The discharge tube extends through the housing and the housing includes a relatively flat portion adjacent the discharge tube where the discharge tube is welded to the housing. The compressor assembly may be a scroll compressor wherein the compressor mechanism includes mutually engaged fixed and orbiting scroll members and the first port is located in the fixed scroll member.

The invention comprises, in another form thereof, a compressor assembly for compressing a gas and lubricated with an oil which includes a hermetically sealed housing having a high pressure discharge chamber defining a first volume and a low pressure chamber. A compressor mechanism is operably disposed within the housing between the high pressure discharge chamber and the low pressure chamber and defines a working space in which gas is compressed. A motor for driving the compressor mechanism is located in the low pressure chamber. A first port is in communication with the working space and the high pressure chamber and provides for the communication of compressed gas and oil from the working space to the high pressure chamber. A second port in communication with the high pressure chamber defines an outlet in the housing. The second port is disposed vertically below the first port with a majority of the first volume disposed vertically above the second port and wherein substantially all fluids entering the discharge chamber enter through the first port and substantially all fluids exiting the discharge chamber exit through the second port.

The compressor assembly also includes a housing which defines an inlet opening in communication with the low pressure chamber. The low pressure chamber also defines an oil sump.

The invention comprises, in another form thereof, a method of controlling the movement and accumulation of oil in a compressor mechanism. The method includes providing an hermetically sealed housing defining a high pressure chamber and a low pressure chamber and providing a compressor mechanism within the housing. The compressor mechanism is used to compress gas. Oil and compressed gas are discharged from the compressor mechanism into the high pressure chamber through a first port. Oil is accumulated in a bottom portion of the high pressure chamber. A second port is positioned in the high pressure chamber vertically between the bottom portion and the first port and the accumulation of oil is limited within the high pressure chamber by discharging excess oil through the second port together with compressed gas. The method also includes enclosing the high pressure chamber wherein substantially all fluids entering and discharged from the high pressure chamber enter and exit the high pressure chamber through the first and second ports.

The method may also include providing a motor for driving the compressor mechanism and disposing the motor in the low pressure chamber. The method may also include the step of circulating oil within the low pressure chamber. The step of circulating oil within the low pressure chamber includes collecting oil within an oil sump disposed within the low pressure chamber. The compressor mechanism may include a fixed scroll member and an orbiting scroll member wherein the step of compressing a gas with the compressor mechanism involves orbiting the orbiting scroll member relative to the fixed scroll member.

An advantage of the present invention is that by positioning the outlet port of the discharge chamber in the lower portion of the discharge chamber, the vapor flow of compressed gas exiting the discharge chamber removes oil from the discharge chamber when an excess quantity of oil has collected in the discharge chamber.

Another advantage of the present invention is that by using a discharge tube which extends through the compressor housing at a flat portion of the housing the attachment of the discharge tube to the housing, such as by resistance welding, is facilitated.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Figure 1:
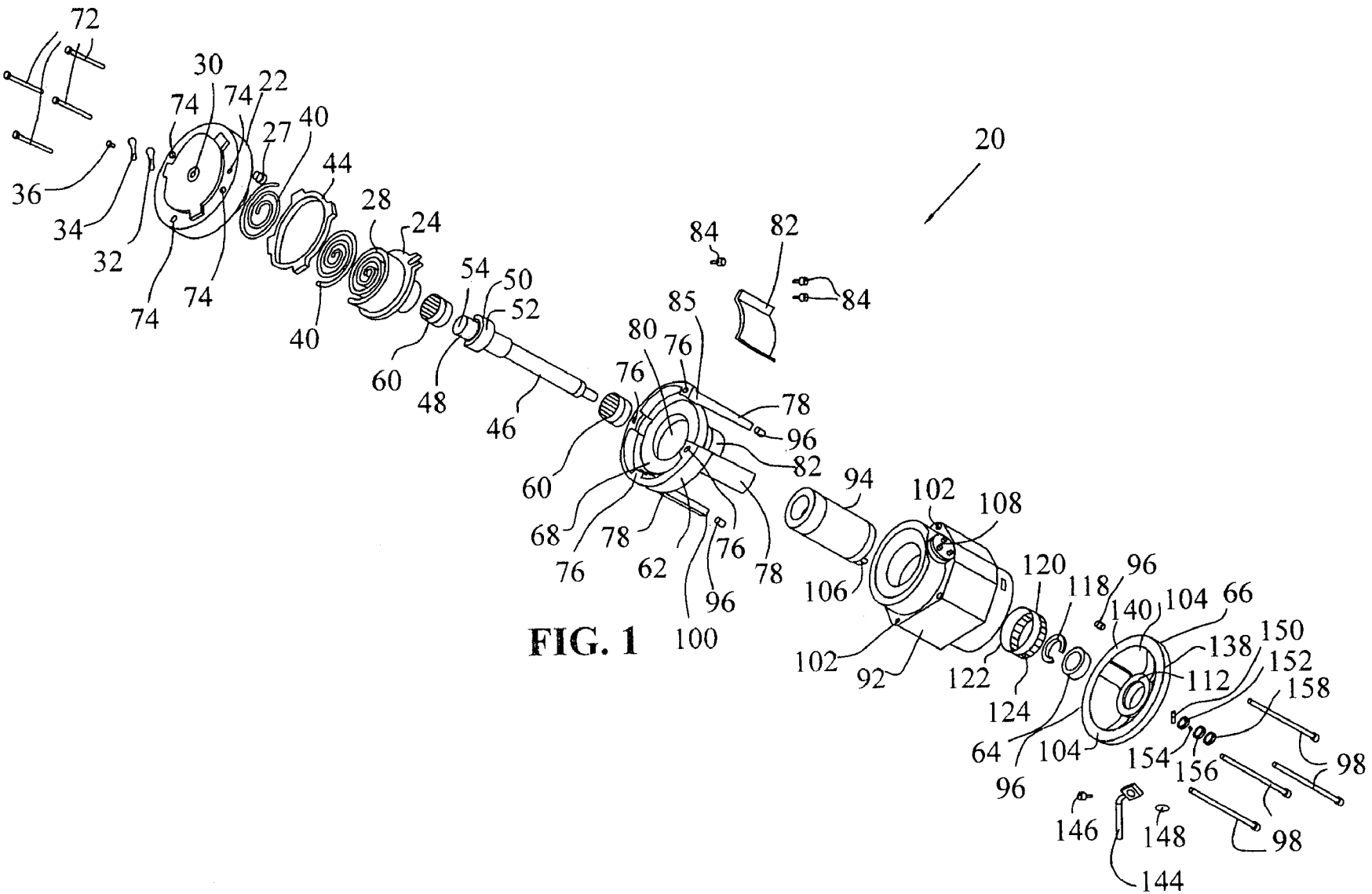
FIG. 1 is an exploded view of a scroll compressor in accordance with the present invention.

Corresponding reference characters indicate corresponding parts throughout the several views. Although the exemplification set out herein illustrates an embodiment of the invention, the embodiment disclosed below is not intended to be exhaustive or to be construed as limiting the scope of the invention to the precise form disclosed.

DESCRIPTION OF THE PRESENT INVENTION

In accordance with the present invention, a scroll compressor 20 is shown in an exploded view in FIG. 1. Scroll compressor 20 includes a fixed or stationary scroll member 22 which is engaged with an orbiting scroll member 24. Fixed and orbiting scroll members 22, 24 respectively include an involute wrap 26, 28. A refrigerant is compressed between scroll members 22, 24 in pockets which are formed between involute wraps 26, 28 and which migrate radially inwardly as scroll member 24 orbitally moves relative to fixed scroll member 22. The refrigerant enters the space between the scroll members at low pressure through inlet 23 (FIG. 4) located at the radially outer portion of the space formed between scroll members 22, 24 and is discharged at a relatively high pressure through a discharge port 30 located proximate the radial center of fixed scroll member 22. Scroll members 22, 24 each have carbon steel tip seals 40 mounted in recesses located in the distal tips of involute wraps 26, 28, for providing a seal between involute wraps 26, 28 and the base plate of the opposing scroll member.

A one-way valve allows compressed refrigerant to be discharged into a discharge chamber or plenum 38 and prevents compressed refrigerant located in discharge plenum 38 from reentering discharge port 30. The valve includes an exhaust valve leaf 32 which sealingly engages fixed scroll member 22 at discharge port 30 and an exhaust valve retainer 34. Valve leaf 32 is secured between fixed scroll member 22 and valve retainer 34. Valve retainer 34 has a bend at its distal end which allows valve leaf 32 to flex outwardly away from discharge port 30 when gas is compressed between scroll members 22, 24 and thereby permit the passage of high pressure gas into discharge plenum 38. Valve retainer 34 limits the extent to which valve leaf 32 may flex outwardly away from discharge port 30 to prevent damage from excessive flexing of valve leaf 32. A threaded fastener 36 secures valve retainer 34 and valve leaf 32 to fixed scroll member 22. An alternative valve that may be used with compressor 20 is described by Haller et al. in U.S. Provisional Patent Application Ser. No. 60/412,905 entitled COMPRESSOR HAVING DISCHARGE VALVE filed on Sep. 23, 2002 and which is hereby incorporated herein by reference. Pressure relief valve 27 is positioned between scroll members 22, 24 to allow discharge pressure gas to be directed into the suction pressure inlet in the event of overpressurization.

An Oldham ring 44 is disposed between fixed scroll member 22 and orbiting scroll member 24 to control the relative motion between orbiting scroll member 24 and fixed scroll member 22. Orbiting scroll 24 is mounted on an eccentrically positioned extension 48 on shaft 46 and rotation of shaft 46 imparts a relative orbital movement between orbiting scroll 24 and fixed scroll 22. The use of shafts having eccentrically positioned extensions and Oldham rings to impart a relative orbital motion between scroll members of a compressor is well known to those having ordinary skill in the art.

A counterweight 50 (FIG. 1) includes a collar portion with an opening through which shaft 46 is inserted. Counterweight 50 is not shown in FIGS. 3 and 4. Counterweight 50 also includes a partially cylindrical wall 52 which eccentrically loads shaft 46 to counterbalance the eccentric loading of shaft 46 by orbiting scroll 24. Counterweight 50 is heat shrink fitted onto shaft 46 in the disclosed embodiment. Shaft 46 includes an internal passageway 54 extending the longitudinal length of shaft 46 and secondary passages 56 extending transversely from passageway 54 to the radially outer surface of shaft 46. Passageways 54, 56 communicate lubricating oil between oil sump 58, which is located in the suction pressure chamber of the compressor housing, and bearings rotatably engaging shaft 46.

Two roller bearings 60 are positioned on shaft 46 where shaft 46 respectively engages orbiting scroll 24 and crankcase 62. A ball bearing 64 is positioned near the opposite end of shaft 46 and is mounted within bearing support 66. Shaft 46 may be supported in a manner similar to that described by Haller et al. in U.S. patent application Ser. No. 09/964,241 filed Sep. 26, 2001 entitled SHAFT AXIAL COMPLIANCE MECHANISM and which is hereby incorporated herein by reference.

Crankcase 62 is secured to fixed scroll 22 with threaded fasteners 72 which pass through apertures 74 located in fixed scroll 22 and engage threaded bores 76 in crankcase 62. Crankcase 62 includes a thrust surface 68 which slidably engages orbiting scroll 24 and restricts movement of orbiting scroll 24 away from fixed scroll 22. Crankcase 62 also includes four legs 78 which secure the crankcase to stator 92 as described in greater detail below. Shaft 46 extends through opening 80 in crankcase 62. Crankcase 62 includes a shroud portion 70 which is disposed between legs 78 in the lower portion of the horizontal compressor housing and partially encloses a space within which counterweight 50 rotates. Shroud 70 includes an opening 81 along its upper portion which permits the equalization of pressure between the space partially enclosed by shroud 70 and the remainder of the low pressure chamber or plenum 39 of compressor 20. Low pressure plenum 39 includes that space within compressor housing 88 located between orbiting scroll 24 and end cap 168 and receives the suction pressure refrigerant which is returned to compressor 20 through inlet tube 86.

Figure 4:
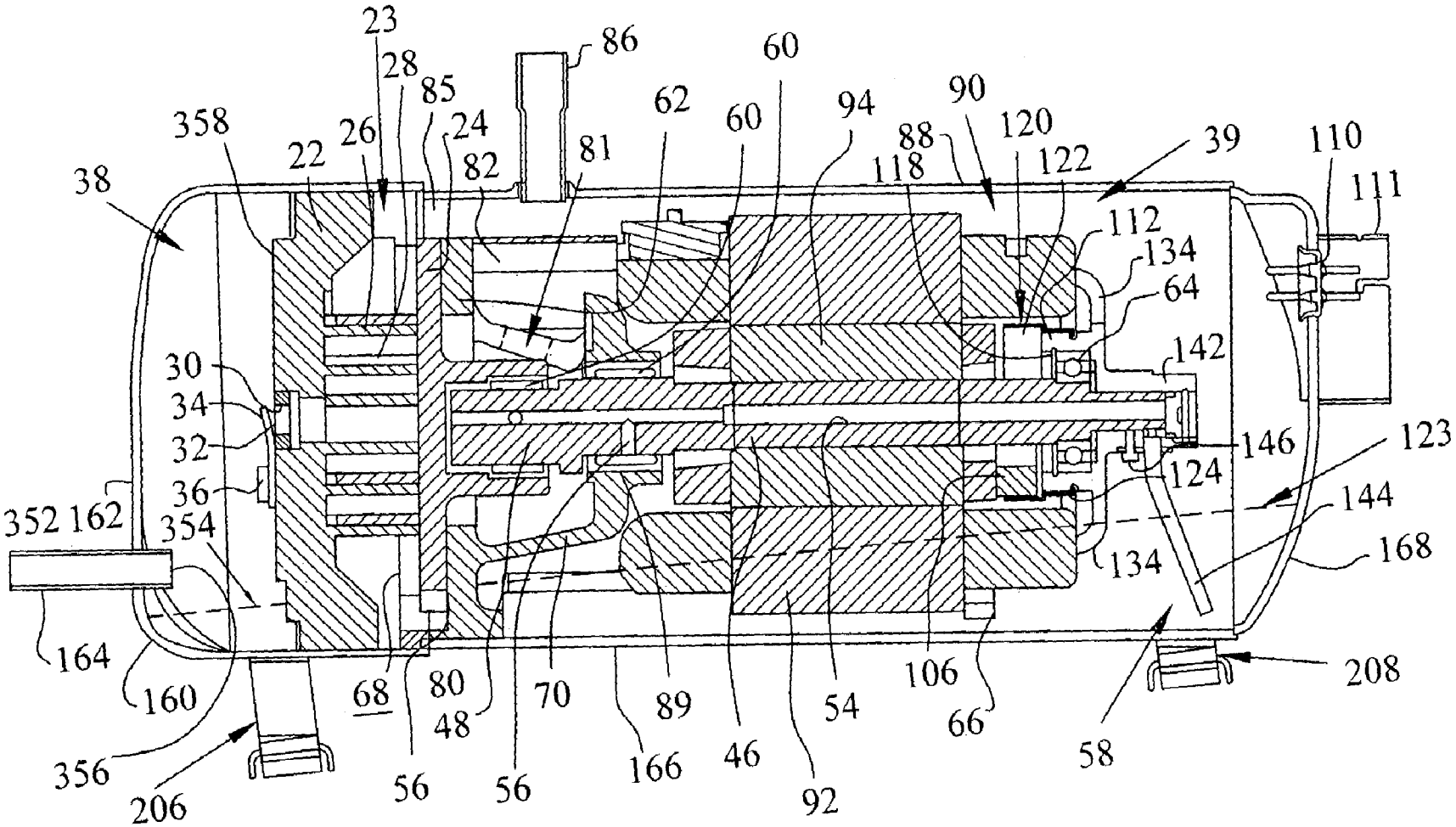
FIG. 4 is a sectional view of the compressor of FIG. 2 taken along line 4—4.

A suction baffle 82 (FIG. 1) is secured between two legs 78 using fasteners. The illustrated fasteners are socket head cap screws 84 but other fasteners such as self-tapping screws and other fastening methods may also be used to secure suction baffle 82. Suction baffle 82 is positioned proximate inlet tube 86 as best seen in FIG. 4. Refrigerant enters compressor housing 88 through inlet tube 86 and suction baffle 82 is positioned in the flow path of entering refrigerant to redirect the refrigerant along the outer perimeter of crankcase 62. The outer perimeter of crankcase 62 includes a recess 85 adjacent suction baffle 82 which defines a passage to inlet 23. Crankcase 62 includes a sleeve portion 89 in which roller bearing 60 is mounted for rotatably supporting shaft 46. Sleeve 89 is supported by shroud portion 70 opposite opening 80. An alternative crankcase and suction baffle assembly may include an inlet to housing 88 located at mid-height wherein the suction baffle has a narrow opening located between inlet 86 and inlet 23 which extends transverse to the flow direction of refrigerant along the suction baffle to strip oil from the suction baffle. Crankcases and suction baffles which may be used with compressor 20 are described by Haller, et al. in U.S. Provisional Patent Application Ser. No. 60/412,768 entitled COMPRESSOR ASSEMBLY filed on Sep. 23, 2002 and which is hereby incorporated herein by reference.

A motor 90 is disposed adjacent crankcase 62 and includes a stator 92 and a rotor 94. Bushings 96 are used to properly position stator 92 with respect to crankcase 62 and bearing support 66 when assembling compressor 20. During assembly, crankcase 62, motor 90 and bearing support 66 must have their respective bores through which shaft 46 is inserted precisely aligned. Smooth bore pilot holes 100, 102, 104 which are precisely located relative to these bores are provided in crankcase 62, motor 90 and bearing support 66. Alignment bushings 96 fit tightly within the pilot holes to properly align crankcase 62, motor 90 and bearing support 66. Bolts 98 (FIG. 1) are then used to secure bearing support 66, motor 90 and crankcase 62 together. Pilot holes 100 are located on the distal ends of legs 78 in crankcase 62 and bolts 98 are threaded into engagement with threaded portions of holes 100 when securing crankcase 62, motor 90 and bearing support 66 together. Pilot holes 102 located in stator 92 of motor 90 extend through stator 92 and allow the passage of bolts 98 therethrough. Pilot holes 104 located in bearing support 66 also allow the passage of the shafts of bolts 98 therethrough but prevent the passage of the heads of bolts 98 which bear against bearing support 66 when bolts 98 are engaged with crankcase 62 to thereby secure crankcase 62, motor 90 and bearing support 66 together. In the disclosed embodiment, bushings 96 are hollow sleeves and bolts 98 are inserted through bushings 96. Alternative embodiments, however, could employ pilot holes and bushings to properly align crankcase 62, motor 90 and bearing support 66 with different methods of securing these parts together. For example, the pilot holes could be separate from the openings through which bolts 98 are inserted or alternative methods of securing crankcase 62, motor 90 and bearing support 66 together could be employed with the use of pilot holes and alignment bushings 96. Alignment bushings which may be used with compressor 20 are described by Skinner in U.S. Provisional Patent Application Ser. No. 60/412,868 entitled COMPRESSOR HAVING ALIGNMENT BUSHINGS AND ASSEMBLY METHOD filed on Sep. 23, 2002 and which is hereby incorporated herein by reference.

A terminal pin cluster 108 is located on motor 90 and wiring (not shown) connects cluster 108 with a second terminal pin cluster 110 mounted in end cap 168 and through which electrical power is supplied to motor 90. A terminal guard or fence 111 is welded to end cap 168 and surrounds terminal cluster 110. Shaft 46 extends through the bore of rotor 94 and is rotationally secured thereto by a shrink fit whereby rotation of rotor 94 also rotates shaft 46. Rotor 94 includes a counterweight 106 at its end proximate bearing support 66.

As mentioned above, shaft 46 is rotatably supported by ball bearing 64 which is mounted in bearing support 66. Bearing support 66 includes a central boss 112 which defines a substantially cylindrical opening 114 in which ball bearing 64 is mounted. A retaining ring 118 is fitted within a groove 116 located in the interior of opening 114 to retain ball bearing 64 within boss 112. An oil shield 120 is secured to boss 112 and has a cylindrical portion 122 which extends towards motor 90 therefrom. Counterweight 106 is disposed within the space circumscribed by cylindrical portion 122 and is thereby shielded from the oil located in oil sump 58, although it is expected that the oil level 123 will be below oil shield 120 under most circumstances, as shown in FIG. 4. Oil shield 120 is positioned so that it inhibits the impacting of counterweight 106 on oil migrating to oil sump 58 and also inhibits the agitation of oil within oil sump 58 which might be caused by the movement of refrigerant gas created by the rotation of eccentrically positioned counterweight 106. A second substantially cylindrical portion 124 of oil shield 120 has a smaller diameter than the first cylindrical portion 122 and has a plurality of longitudinally extending tabs with radially inwardly bent distal portions. Boss 112 includes a circular groove and oil shield 120 is secured to boss 112 by engaging the radially inwardly bent distal portions with the circular groove. An oil shield which may be used compressor 20 is described by Skinner in U.S. Provisional Patent Application Ser. No. 60/412,838 entitled COMPRESSOR HAVING COUNTERWEIGHT SHIELD filed on Sep. 23, 2002 and which is hereby incorporated herein by reference.

Support arms 134 extend between boss 112 and outer ring 136 of bearing support 66. The outer perimeter of ring 136 is press fit into engagement with housing 88 to secure bearing support 66 therein. The interior perimeter of outer ring 136 faces the windings of stator 92 when bearing support 66 is engaged with motor 90. Flats 138 are located on the outer perimeter of ring 136 and the upper flat 138 facilitates the equalization of pressure within suction plenum by allowing refrigerant to pass between outer ring 136 and housing 88. Flat 138 located along the bottom of ring 136 allows oil in oil sump 58 to pass between ring 136 and housing 88. A notch 140 located on the interior perimeter of outer ring 136 may be used to locate bearing support 66 during machining of bearing support 66 and also facilitates the equalization of pressure within suction plenum 39 by allowing refrigerant to pass between stator 92 and ring 136. The outer perimeter of stator 92 also includes flats to provide passages between stator 92 and housing 88 through which lubricating oil and refrigerant may be communicated.

Support arms 134 are positioned such that the two lowermost arms 134 form an angle of approximately 120 degrees to limit the extent to which the two lowermost arms 134 extend into the oil in sump 58 and thereby limit the displacement of oil within oil sump 58 by such arms 134. A sleeve 142 projects rearwardly from bearing support 66 and provides for uptake of lubricating oil from oil sump 58. An oil pick up tube 144 is secured to sleeve 142 with a threaded fastener 146. An O-ring 148 provides a seal between oil pick up tube 144 and sleeve 142. As shown in FIG. 1, secured within a bore in sleeve and positioned near the end of shaft 46 are vane 150, reversing port plate 152, pin 154, washer and wave spring 156, and retaining ring 158 which facilitate the communication of lubricating oil through sleeve 142. Although appearing as one part in FIG. 1, washer and wave spring 156 are two separate parts wherein the washer is a flat circular part which does not include a central opening while the wave spring is formed from a sheet material and has a circular outer perimeter and central opening and circumferentially extending undulations. Such washers and wave springs are known in the art. A bearing support which may be used with compressor 20 is described by Haller in U.S. Provisional Patent Application Ser. No. 60/412,890 entitled COMPRESSOR HAVING BEARING SUPPORT filed Sep. 23, 2002 and which is hereby incorporated herein by reference. The bearing support may also include one or more circumferentially spaced recesses in the surface of the outer ring which bears against the stator whereby any bulges in the laminations of the stator caused by the securing of the bearing support against the stator may project into the recesses. The use of such recesses is described by Skinner et al. in U.S. patent application Ser. No. 10/617,475 entitled BEARING SUPPORT AND STATOR ASSEMBLY FOR COMPRESSOR which is hereby incorporated herein by reference.

Figure 3:
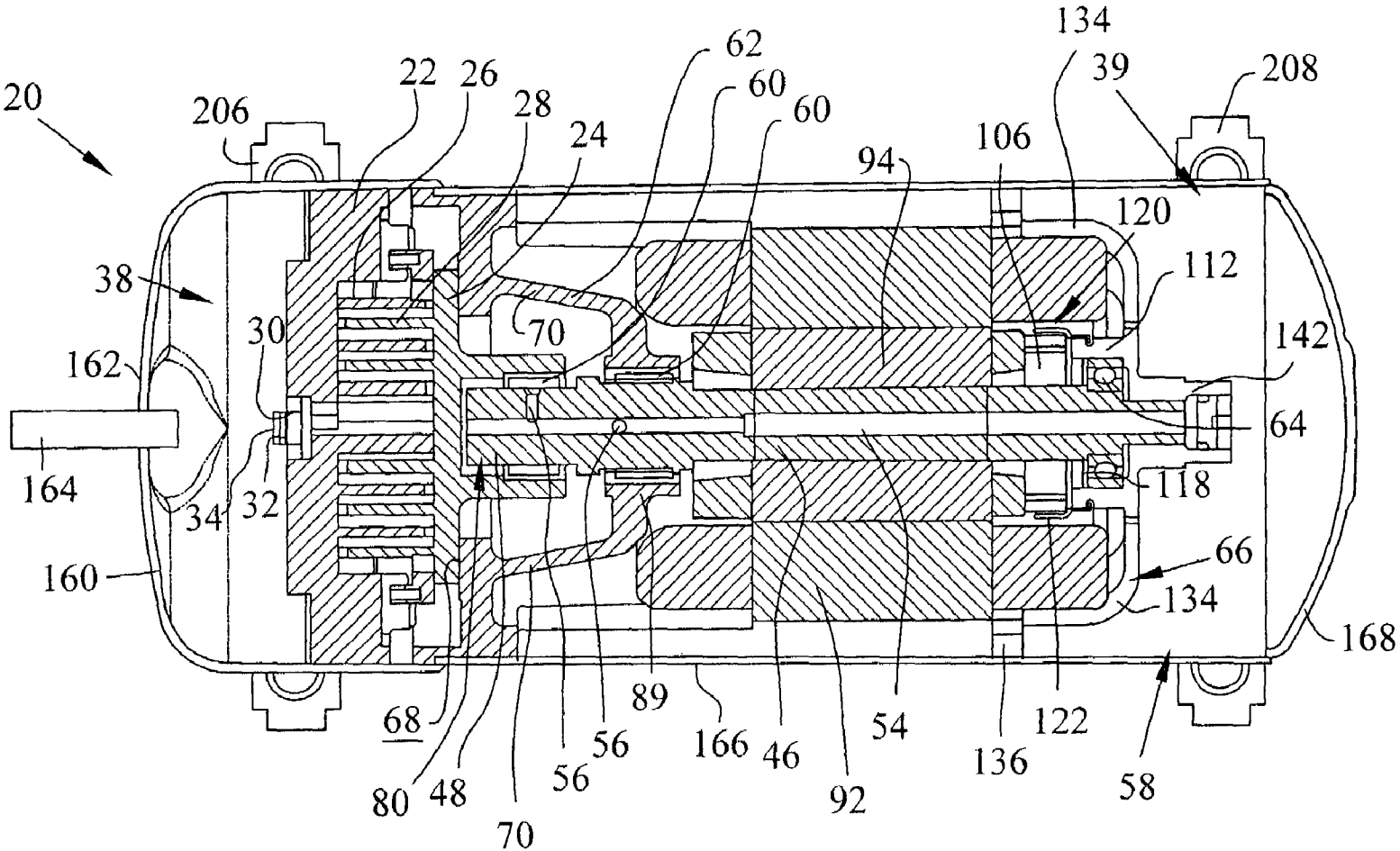
FIG. 3 is a sectional view of the compressor of FIG. 2 taken along line 3—3.
Figure 5:
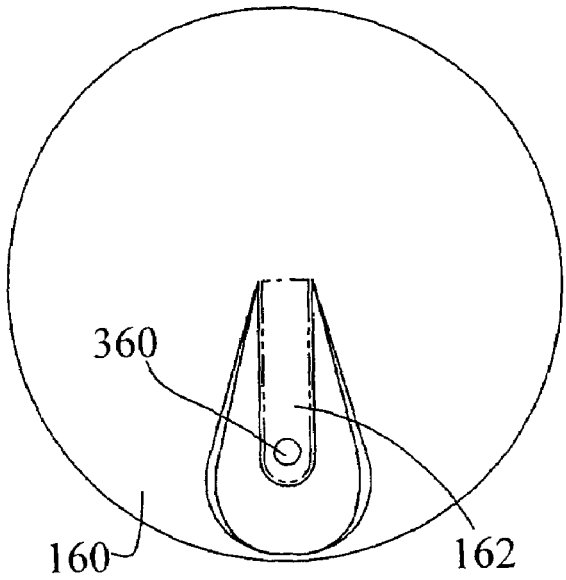
FIG. 5 is an end view of an end cap.
Figure 6:
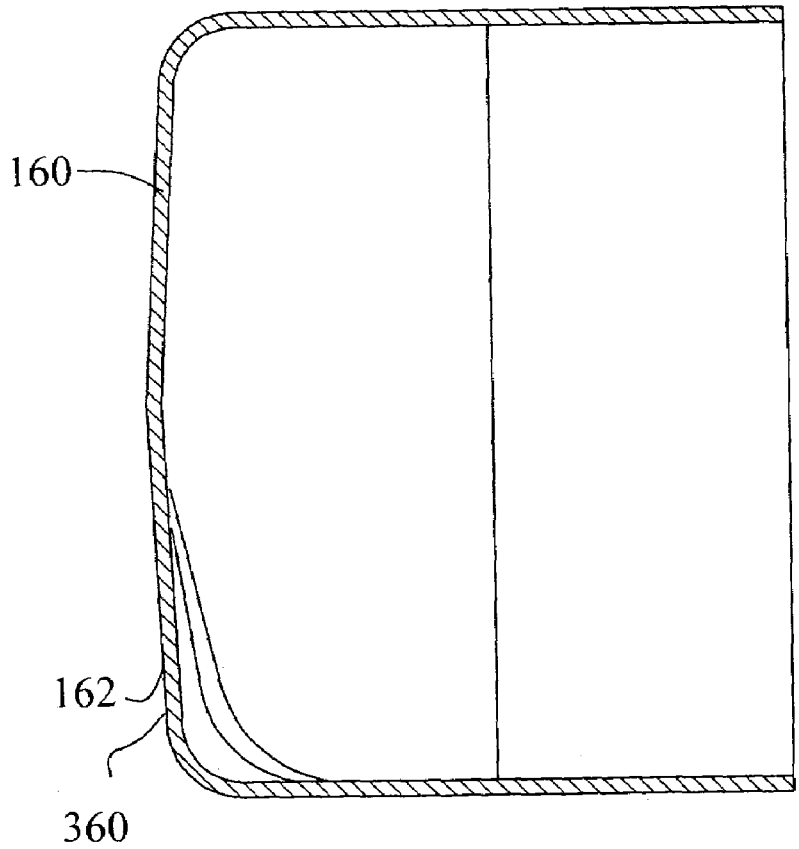
FIG. 6 is a cross sectional view of an end cap.

As can be seen in FIGS. 3 and 4, compressor housing 88 includes a discharge end cap 160 having a relatively flat portion 162. Housing 88 also includes a cylindrical shell 166 and rear end cap 168. End caps 160, 168 are welded to cylindrical shell 166 to provide an hermetically sealed enclosure. End caps 160, 168 are manufactured using a deep drawn steel stamping process. A discharge tube 164 extends through an opening 360 in flat portion 162. The securement of discharge tube 164 to end cap 160 by welding or brazing is facilitated by the use of flat portion 162 immediately surrounding the opening through which discharge tube 164 is positioned. End cap 160 is shown in FIGS. 5 and 6 and the border of flat portion 162 is shown with a phantom line in FIG. 5. In the disclosed embodiment, discharge tube 164 is a copper plated steel tube which is resistance welded to end cap 160. The use of a steel tube provides strength to discharge tube 164 and also facilitates the resistance welding of tube 164 to end cap 160. The use of copper plating on discharge tube 164 facilitates a soldered connection to discharge tube 164. The end user of compressor 20 may thereby readily make a soldered connection to the end of tube 164 which extends outwardly from compressor 20.

After the compressor and motor subassembly is assembled and shrink-fitted into cylindrical housing shell 166, fixed scroll member 22 is positioned within discharge end cap 160 and tightly engages the interior surface of end cap 160. Discharge plenum 38 is formed between discharge end cap 160 and fixed scroll member 22. As compressed refrigerant is discharged through discharge port 30 it enters discharge plenum 38 and is subsequently discharged from compressor 20 through discharge tube 164. Compressed refrigerant carries oil with it as it enters discharge plenum 38. Some of this oil will separate from the refrigerant and accumulate in the bottom portion of discharge plenum 38. Discharge tube 164 has an entry port 356 located near the bottom portion of discharge plenum 38 so that the vapor flow discharged through tube 164 will carry with it oil which has settled to the bottom portion of discharge plenum 38 and thereby limit the quantity of oil which can accumulate in discharge plenum 38. Line 354 in FIG. 4 represents the upper surface of oil accumulated in discharge chamber 38. During normal operation of compressor 20, upper surface 354 of accumulated oil in discharge chamber 38 will typically be slightly below the lowermost portion of entry port 356.

Discharge chamber 38 defined by end cap 160 and rear surface 358 of fixed scroll 22 is a hermetically sealed chamber with discharge port 30 and entry port 356 defining the only openings therein. As described above, compressed refrigerant and oil enters discharge chamber 38 through discharge port 30 and valve 34 prevents the passage of refrigerant or oil from discharge chamber 38 into port 30. Entry port 356 to discharge tube 164, through which compressed refrigerant and oil passes during discharge from discharge chamber 38, is located vertically below port 30 and in the lower half of discharge chamber 38.

The disclosed embodiment utilizes a discharge tube 164 which has an inner portion 350 located within discharge chamber 38 which has a short, straight length which is oriented substantially horizontal. Alternative embodiments of the discharge outlet for the compressor could utilize a tube which enters discharge plenum at a vertically higher or lower location with the tube extending downwardly or upwardly within the plenum so that the inlet to the discharge tube was still located near the bottom of the discharge plenum to limit the quantity of oil which could accumulate therein. The outer portion 352 of discharge tube 164 may be bent at a 90 degree angle such that the outer portion of the tube extends transverse to the direction of shaft 46 in the same substantially horizontal plane as the remainder of discharge tube 164. The oil discharged from compressor 20 via discharge tube 164 is carried with the refrigerant through a condensing circuit and the refrigerant and oil returns to compressor 20 via intake tube 86.

Figure 2:
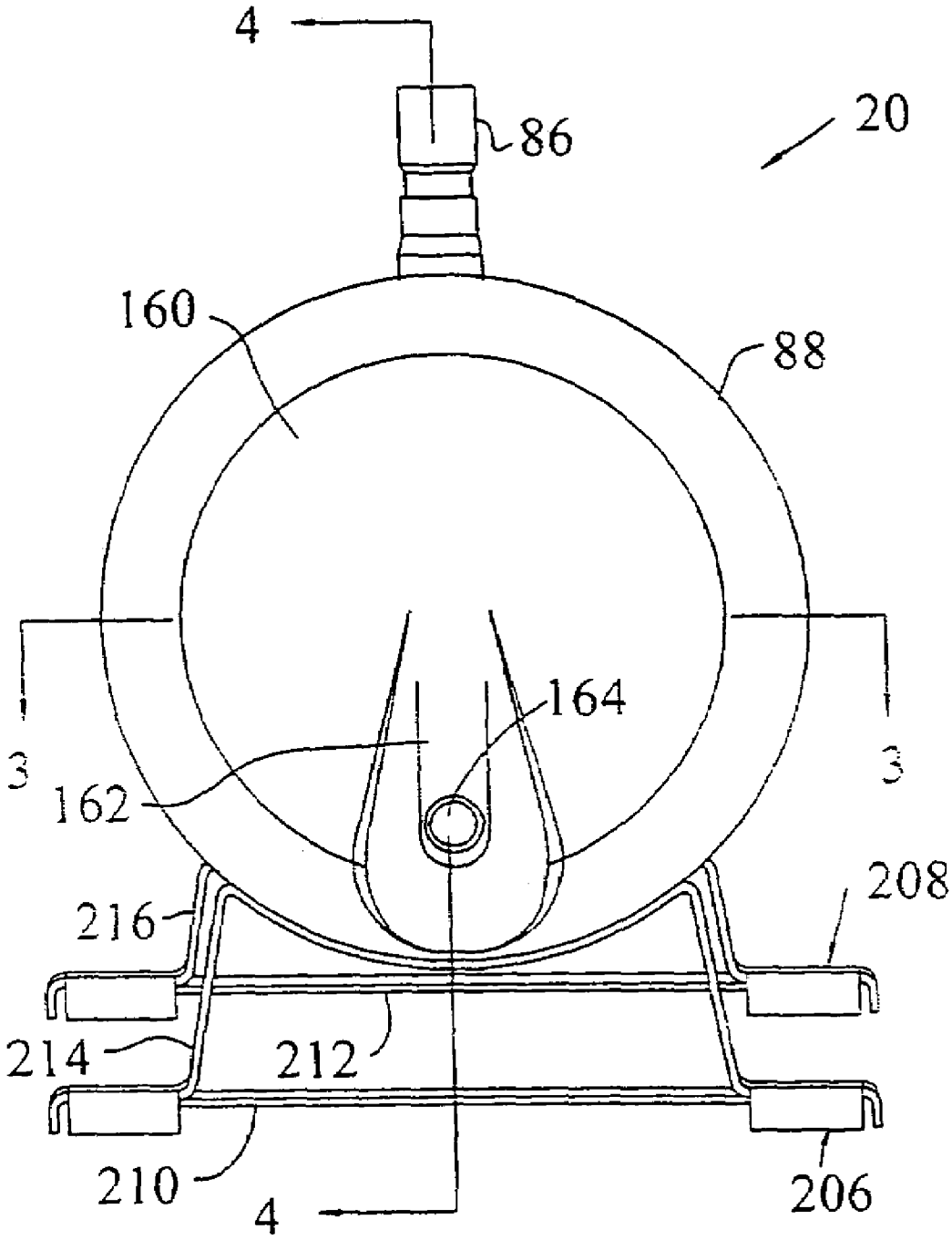
FIG. 2 is an end view of the compressor of FIG. 1.

Mounting brackets 206 and 208 are welded to housing 88 and support compressor 20 in a generally horizontal orientation. As can be seen in FIG. 4, however, mounting brackets 206, 208 have legs which differ in length such that the axis of shaft 46 defined by passage 54 while substantially horizontal will be positioned at an incline. The configuration of brackets 206, 208 are such that the portion of low pressure plenum 39 positioned below bearing support 66 and which defines oil sump 58 will be the lowermost portion of compressor 20. Bottom brace members 210, 212 may be secured to support members 214, 216 (FIG. 2) by a swaging operation. The mounting brackets used with compressor 20 may be those described by Skinner in U.S. Provisional Patent Application Ser. No. 60/412,884 entitled COMPRESSOR MOUNTING BRACKET AND METHOD OF MAKING filed on Sep. 23, 2002 and which is hereby incorporated herein by reference. Alternative mounting brackets may also be employed. For example, mounting brackets formed by support members similar to members 214 and 216 but which have been given greater rigidity by bending their outer edges downward along the full length of the support members may be used without a crossbrace to support compressor 20.

While this invention has been described as having an exemplary design, the present invention may be further modified within the spirit and scope of this disclosure. This application is therefore intended to cover any variations, uses, or adaptations of the invention using its general principles.

What is claimed is:

1. A compressor assembly for compressing a gas and lubricated with an oil, said compressor assembly comprising:

a housing having an inlet;

a horizontal scroll compressor mechanism disposed within said housing, wherein said compressor mechanism comprises a generally horizontal crankshaft, a fixed scroll member and an orbiting scroll member, said fixed and orbiting scroll members being mutually engaged, wherein said fixed scroll member is sealed against said housing to define a suction chamber and a discharge chamber, said compressor mechanism having an inlet in direct fluid communication with said suction chamber, wherein said suction chamber is in fluid communication with said housing inlet, and wherein said compressor mechanism defines a working space in which gas is compressed, said compressor mechanism having a first port in communication with said discharge chamber whereby oil and compressed gas are communicated from said working space to said discharge chamber; and a second port in said discharge chamber defining an outlet in said housing through which oil and compressed gas are discharged from said compressor assembly, said second port disposed vertically below said first port in a lower half of said discharge chamber whereby oil collected within said discharge chamber is dischargeable with the compressed gas through said second port and wherein substantially all fluids entering said discharge chamber enter through said first port and substantially all fluids exiting said discharge chamber exit through said second port.

2. The compressor assembly of claim 1 further comprising a valve sealingly engageable with said first port, said valve allowing fluids to enter said discharge chamber from said working space and inhibiting passage of fluids from said discharge chamber to said working space.

3. The compressor assembly of claim 1 further comprising a discharge tube, said discharge tube having an inlet positioned in said discharge chamber, said inlet defining said second port.

4. The compressor assembly of claim 3, wherein said discharge tube extends through said housing and said housing includes a relatively flat portion adjacent said discharge tube, said discharge tube being welded to said housing at said flat portion.

5. The compressor assembly of claim 1 wherein said first port is located in said fixed scroll member.

6. A horizontal compressor assembly for compressing a gas and lubricated with an oil, said compressor assembly comprising:

a hermetically sealed housing defining a high pressure discharge chamber and a low pressure chamber, said housing further defining an inlet opening in fluid communication with said low pressure chamber, wherein the bottom portion of said low pressure chamber comprises a first oil reservoir and the bottom portion of said high pressure chamber comprises a second oil reservoir, and wherein said first oil reservoir is partitioned from said second oil reservoir;

a compressor mechanism disposed within said housing, said compressor mechanism operably disposed between said high pressure discharge chamber and said low pressure chamber and defining a working space in which gas is compressed, said compressor mechanism having a generally horizontally oriented crankshaft, said compressor mechanism having an inlet in direct fluid communication with said low pressure chamber and said working space;

a motor for driving said compressor mechanism, said motor located in said low pressure chamber;

a first port in communication with said working space and said high pressure chamber wherein compressed gas and oil are communicated from said working space to said high pressure chamber;

a second port defining an outlet in said housing and in communication with said high pressure chamber, said second port disposed vertically below said first port wherein a majority of said high pressure chamber is disposed vertically above said second port and wherein substantially all fluids entering said discharge chamber enter through said first port and substantially all fluids exiting said discharge chamber exit through said second port.

7. The compressor assembly of claim 6 further comprising a discharge tube, said discharge tube having an inlet positioned in said high pressure chamber, said inlet defining said second port.

8. The compressor assembly of claim 7, wherein said discharge tube extends through said housing and said housing includes a relatively flat portion adjacent said discharge tube, said discharge tube being welded to said housing at said flat portion.

9. The compressor assembly of claim 6 wherein said compressor mechanism comprises a fixed scroll member and an orbiting scroll member, said fixed and orbiting scroll members being mutually engaged, said first port defined by said fixed scroll member.

10. The compressor assembly of claim 9 further comprising a valve sealingly engageable with said first port, said valve allowing fluids to enter said high pressure chamber and inhibiting passage of fluids from said high pressure chamber through said first port.

11. A method of controlling the movement and accumulation of oil in a horizontal compressor, said method comprising:

providing a hermetically sealed housing defining a high pressure chamber and a low pressure chamber, said housing having an inlet;

providing a compressor mechanism within said housing, said compressor mechanism having an inlet;

placing said housing inlet and said compressor mechanism inlet in direct fluid communication with said low pressure chamber;

compressing a gas with said compressor mechanism and discharging oil and compressed gas from said compressor mechanism into said high pressure chamber through a first port;

accumulating oil in a bottom portion of said low pressure chamber;

accumulating oil in a bottom portion of said high pressure chamber;

partitioning the oil in the bottom of said low pressure chamber from the oil in the bottom of said high pressure chamber;

positioning a second port in said high pressure chamber vertically between said bottom portion and said first port;

limiting the accumulation of oil within said high pressure chamber by discharging excess oil through said second port together with compressed gas; and enclosing said high pressure chamber wherein substantially all fluids entering and discharged from said high pressure chamber enter and exit said high pressure chamber through said first and second ports.

12. The method of claim 11 further comprising the step of providing a motor for driving said compressor mechanism and disposing said motor in said low pressure chamber.

13. The method of claim 12 further comprising the step of circulating oil within said low pressure chamber.

14. The method of claim 11 wherein said compressor mechanism comprises a fixed scroll member and an orbiting scroll member and said step of compressing a gas with said compressor mechanism includes orbiting said orbiting scroll member relative to said fixed scroll member.

15. A compressor assembly comprising:

a housing having a low pressure chamber and a high pressure chamber;

a compressor mechanism, wherein said compressor mechanism has an inlet in direct fluid communication with said low pressure chamber and an outlet in fluid communication with said high pressure chamber;

a first oil reservoir in said low pressure chamber;

a second oil reservoir in said high pressure chamber, wherein said first oil reservoir is partitioned from said second oil reservoir;

a suction inlet in said housing, wherein said housing inlet is in fluid communication with said low pressure chamber; and a discharge outlet in said housing, wherein said discharge outlet is in fluid communication with said high pressure chamber, and wherein said housing outlet is positioned vertically below said compressor mechanism outlet, whereby oil in said second reservoir exits said high pressure chamber though said housing outlet.

16. The compressor assembly of claim 15 wherein said compressor mechanism is sealed against said housing to partition said first oil reservoir from said second reservoir.

* * * * *